US006135070A

United States Patent [19]

Crandall

[11] Patent Number: 6,135,070

[45] Date of Patent: Oct. 24, 2000

[54] TWO CYCLE 60 DEGREE V6 AND 90 DEGREE V4 INTERNAL COMBUSTION ENGINE

[75] Inventor: Robert A. Crandall, 6045 Neals Landing Rd., Bascom, Fla. 32423

[73] Assignee: Robert A. Crandall, Bascom, Fla.

[21] Appl. No.: 09/325,324

[22] Filed: Jun. 3, 1999

Related U.S. Application Data

[63] Continuation of application No. 09/002,874, Jan. 5, 1998.

[51] Int. Cl.[7] ..... F02B 75/02

[52] U.S. Cl. ..... 123/65 R; 123/65 BA; 123/559.1; 123/196 R; 123/193.6

[58] Field of Search ..... 123/193.6, 65 R, 123/65 A, 65 BA, 559.1, 196 R

[56] References Cited

U.S. PATENT DOCUMENTS

| | | | |
|---|---|---|---|
| 4,399,778 | 8/1983 | Ancheta | 29/8 |
| 4,466,399 | 8/1984 | Hinz et al. | 123/193.4 |
| 4,671,218 | 6/1987 | Weiland | 123/65 V |
| 4,683,809 | 8/1987 | Taylor | 92/208 |
| 4,736,676 | 4/1988 | Taylor | 92/212 |
| 4,864,979 | 9/1989 | Eickmann | 123/65 BA |
| 4,909,133 | 3/1990 | Taylor et al. | 92/212 |
| 5,027,757 | 7/1991 | Pusic | 123/65 A |
| 5,345,897 | 9/1994 | Linder et al. | 123/65 A |
| 5,769,046 | 6/1998 | Ransone | 123/193.2 |
| 5,884,550 | 3/1999 | Northam | 92/212 |

*Primary Examiner*—Henry C. Yuen
*Assistant Examiner*—Hai Huynh

[57] ABSTRACT

Disclosed is a two cycle engine designed and configured to replace conventional four cycle engines in a modern day automobile without any alternations, while steel accepting all of the accessories (i.e. air conditioning, power steering, alternators), without any modifications to the external structure of the engine block. This engine composites casting carbon—carbon cylinders, having carbon—carbon pistons located therein, into an aluminum block so all of the current external dimensions are maintained for manufacturing purposes.

4 Claims, 5 Drawing Sheets

Front View of Engine

Front View of Engine

Carbon-Carbon Cylinder cast into an Aluminum Block

A Preformed Carbon- Carbon Cylinder and Exhaust Port

TWO CYCLE 60 DEGREE V6 AND 90 DEGREE V4 INTERNAL COMBUSTION ENGINE

This is a file wrapper continuation of patent Ser. No. 09/002,874 filed on Jan. 5, 1998.

BACKGROUND OF THE INVENTION

1. Field of the Invention

The present invention relates generally to a two cycle internal combustion engine and more particularly to a two cycle internal combustion engine which utilizes Carbon—Carbon cylinders and pistons to provide for a final product which is light weight, energy efficient and environmentally operative.

2. Description of the Prior Art

Two cycle combustion engines are known in the field and are not widely used today in automobiles and the like because of environmental concerns. As the consumers become more conscience of their environment as well as their financial spending, many are demanding vehicles which meet the needs of an automobile which is fuel efficient as well as an automobile which is safe and non-harmful to the environment, while not sacrificing the effectiveness of its performance. As such, engines have been developed to address these needs and attempt to improve on the two cycle internal combustion engine, particularly two cycle engines with a standard crank case.

One such engine is disclosed in U.S. Pat. No. 4,399,778 issued to Acheta. In this patent there is disclosed a two stroke engine that includes an intake-and-scavenge valve in the cylinder head together with a fuel injection system, a recirculating type pressure lubricating system, and a blower or turbo charger assisting in charging the cylinder with air and also assisting in scavenging the exhaust gases. The valve is controlled by a cam mounted on a cam shaft upon the cylinder head that is coupled to the crankshaft. Though this device may be successful in operation, the location of the cam provides for a valve assembly which is complex and one which is expensive to operate and utilize. In addition, Ancheta utilizes oil rings which may not be sufficient to prevent the oil from escaping from the crankcase and out the exhaust ports. Thus, this will inherently cause the compression rings to run dry and prevent it from operating efficiently, to innately cause the engine to seize operation and defeat its intended purpose.

In U.S. Pat. No. 4,683,809, issued to Taylor, there is disclosed a lightweight piston made of carbon—carbon which can be used with internal combustion reciprocating engine. Though Taylor teaches carbon—carbon piston, he fails to disclose a means of preventing the piston from seizing during cold weather. During this frigid temperatures the cylinder block would shrink and seize the operation of the piston, to consequently prevent the engine from operating.

Accordingly, it is seen that what is needed is an engine, in particular, a two cycle internal combustion gasoline engine which is powerful, reliable and environmentally safe. Such an engine should be economically feasible for the average consumer, as well as be a product which is safe and structurally stable.

As will be seen, the present invention achieves its intended purposes, objectives and advantages, by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a two cycle engine which incorporates the use of Carbon—Carbon cylinders and pistons. In this arrangement, the Carbon—Carbon cylinders and pistons would eliminate any need for pistons rings, as conventionally utilized, and thus would prevent any leakage to occur. This would inherently provide a device which is not only advantageous to use economically, but is a device which would be powerful, efficient and safe during utilization.

Each Carbon—Carbon cylinder includes a unique design and configuration, thereby providing for each cylinder to include an inner layer or wall having an upper end and a lower end. Extending perpendicularly from the upper end is a flange and extending perpendicularly from the lower end is a pair of parallel flanges. Extending through, and substantially centrally located within the cylinder is an exhaust port. An aluminum outer layer is secured to the inner layer or wall for forming the engine block. The flanges and exhaust port force a gap to be located between the inner layer and aluminum block. Located between the layers is a coolant such as water.

The engine of the present invention further includes a conventional supercharger to supply air to the cylinders for scavenging and combustion. For rendering proper operation, each cylinder will include two intake valves, one fuel injector and one spark plug. This will enable conventional operation of the cylinders of the present invention.

Accordingly, it is the object of the present invention to provide for a two cycle internal combustion engine which will overcome the deficiencies, shortcomings, and drawbacks of prior two cycle internal combustion engines and methods thereof.

Another object of the present invention is to provide for a two cycle internal combustion engine which reduce the number of components generally required to successfully operate a conventional engine.

Still a further object of the present invention is to provide for cylinders used in a two cycle internal combustion engine to be self lubricating to provide for an energy efficient engine which does not sacrifice performance.

Yet another object of the present invention, to be specifically enumerated herein, is to provide a two cycle internal combustion engine, including self lubricating cylinders, in accordance with the preceding objects and which will conform to conventional forms of manufacture, be of simple construction and easy to use so as to provide a device that would be economically feasible, long lasting and relatively trouble free in operation.

Although there have been many inventions related to two cycle internal combustion engines, none of the inventions have become sufficiently compact, low cost, environmentally acceptable and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
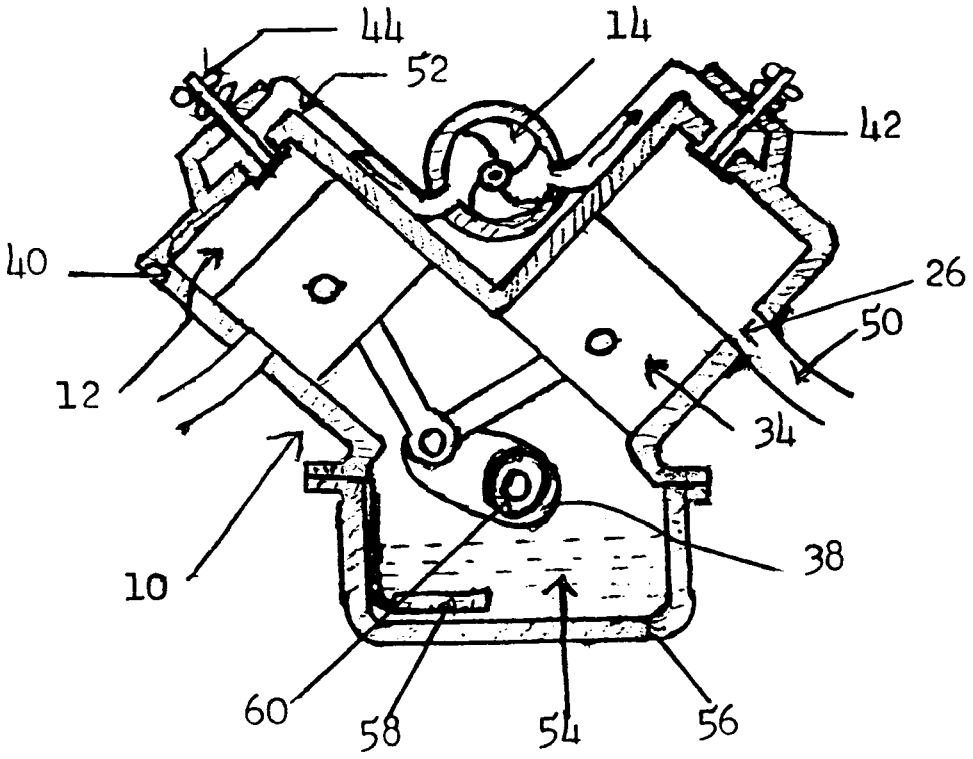
FIG. 1 is a side elevational partially sectioned viewed illustrating the two cycle internal combustion engine of the present invention.

With reference to the drawings, in particular to FIGS. 1–5*e*, the present invention, a two cycle internal combustion engine, denoted by reference numeral 10, will be described. As seen throughout the various views of the drawings, in particular to FIG. 1, the present invention 10 is designed to be either a V4 or V6-type engine configuration, which utilizes a plurality of cylinders 12 and a conventional supercharger 14, preferably the LYSHOLM supercharger.

Figure 3:
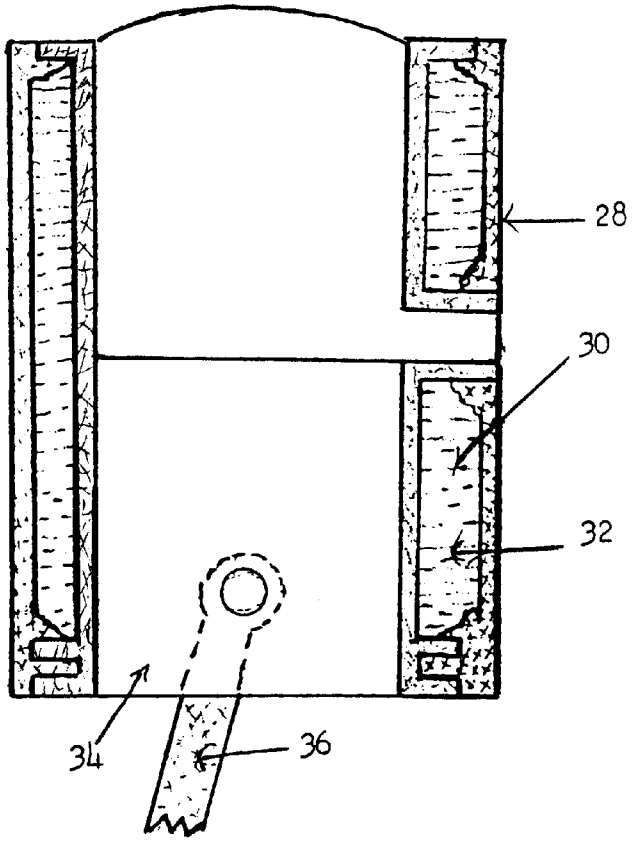
FIG. 3 is an enlarged cross-sectional view of the aluminum block cast onto the Carbon—Carbon cylinder used with the two cycle internal combustion engine of the present invention.
Figure 2:
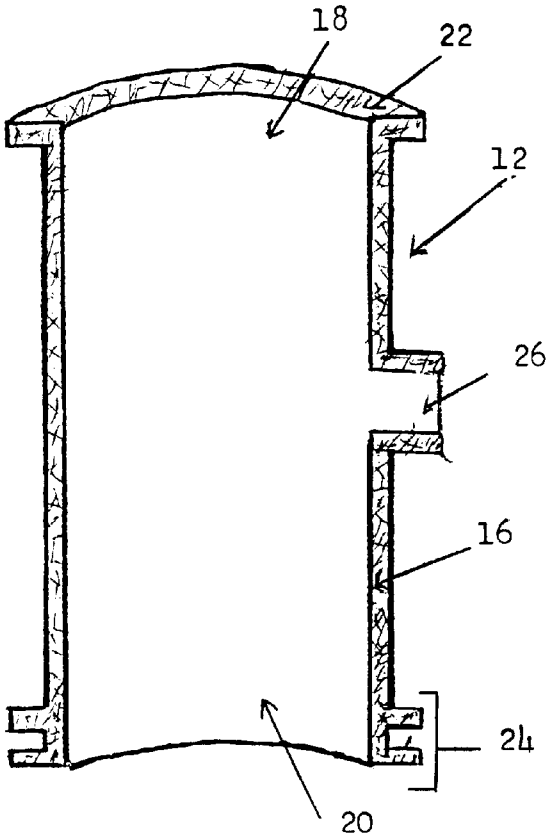
FIG. 2 is an enlarged cross-sectional view of the Carbon—Carbon cylinder used with the two cycle internal combustion engine of the present invention.

The cylinders 12, as seen in FIGS. 1, 2 and 3 include a unique structure, so as to provide a final product which is advantageous to the consumer and manufacturer. As seen in these figures, each cylinder 12 includes an encompassing side wall 16 having an opened upper end 18 and an opened lower end 20. Secured to the upper end of the cylinder 12 and extending outwardly therefrom is an upper flange 22. A pair of parallel flanges 24 are secured to the lower end 20 of the encompassing wall 16. Extending through, and substantially centrally within the cylinder is an exhaust port 26. It is noted that this exhaust port 26 is illustrated as being perpendicularly secured thereto, with respect to the side wall of the cylinder. However, it is noted that this exhaust port 26 can be attached at any angular position with respect to the side wall 16 of the cylinder 12.

This circumfercial wall 16, including the upper flange 22, pair of flanges 24 and exhaust port 26 form an integral structure that is fabricated from Carbon—Carbon, and thus provides the shape of each cylinder 12. The use of Carbon—Carbon provides a cylinder which incorporates the latest in composite materials to provide a final product with unique properties for enhancing an internal combustion engine. Using Carbon—Carbon in the cylinder will provide for a cylinder which includes a near zero coefficient of thermal expansion and one that will retain its room strength with increasing temperatures. In addition, this Carbon—Carbon composite is light weight, thereby will innately reduce the overall weight of the final product.

The formed cylinders will be positioned in a mold so that an aluminum block 28 can be cast around them to form a complete engine block. The flanges, 22 and 24, respectively, provide an inherent gap 30 to be located between the carbon—carbon circumfercial wall 16 and the aluminum block 28. This gap will receive a coolant 32, such as water or the like. Conventional means will be utilized for enabling additional coolant to be added as necessary, for the normal operation of the engine. Each carbon—carbon cylinder should be perma-filled, exteriorly, so as to prevent any possibility of coolant from entering the cylinder bore. This coolant will cause the Carbon—Carbon layer to remain at a constant temperature, and thus eliminate any chance of thermal expansion, especially during frigid conditions. Due to the molding process, each cylinder wall will have a nearly zero thermal expansion or contraction.

Preferably, the block and cylinders will be designed so that the exhaust ports will slope downward and outward, with respect to the plan horizontal axis. This slope will facilitate the flow of exhaust gases.

Located within each cylinder is a piston 34. This piston, like the cylinder, is fabricated from Carbon—Carbon composite. Since the piston is fabricated from a Carbon—Carbon composite, having zero thermal expansion, they will be fitted very closely to the interior walls of the cylinder, and thereby, will not require the use of rings, gaskets or the like. Utilizing Carbon—Carbon composite for both the cylinder and piston provides a system which is self lubricating. Self lubrication occurs because the cylinder walls are under constant oil spray from the crankshaft and due to the somewhat porous properties of the carbon—carbon composite, the cylinder and piston will receive and retain some of the oil. This amount is of a signification quantify so as to render one hundred percent bearing surface. As seen in FIG. 1, a connecting rod 36 is secured to the piston 34 and couples the piston 34 to a conventional crank shaft 38. It is noted that conventional pins are used for securing the crank shaft to the piston. To allot for expansion of the conventional pins, known as piston pins, they are secured loosely to the piston. This loose attachment will enable the pins to expand and thus prevent and prevent cracking to occur within the piston.

Both the cylinder 16 and piston 34 can be coated with a silicon carbide. For the cylinders, coating can occur internally. This coating will provide a one hundred percent bearing surface from piston to cylinder wall. Thus, providing a perfect seal between the interior surface of the cylinder the exterior surface of the piston. Coating will also increase the wearablity of the cylinders and pistons.

Figure 4:
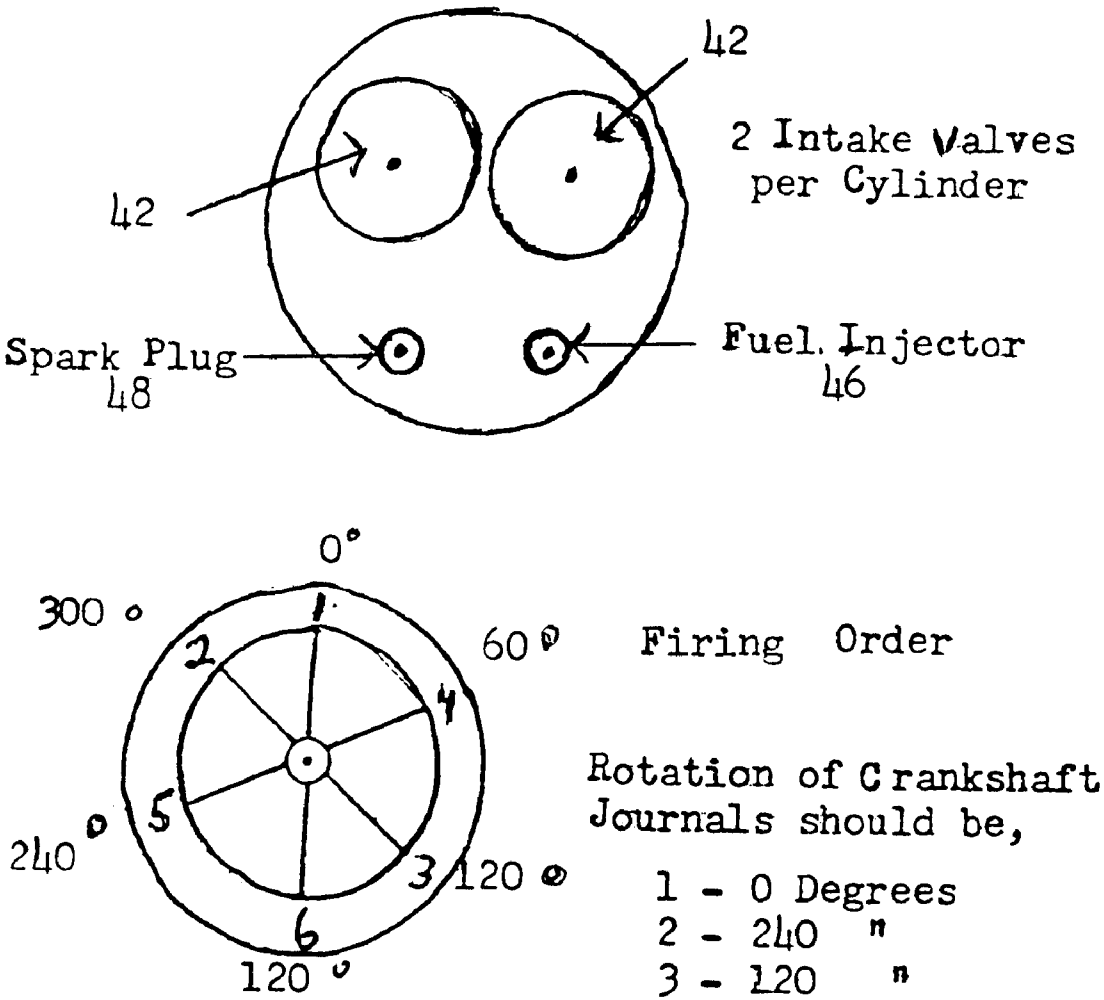
FIG. 4 is a top view of a cylinder used with the two cycle internal combustion engine of the present invention.

Secured to the top of each cylinder 16, via conventional means, is a cylinder head assembly 40. This cylinder head assembly 40, illustrated in FIGS. 1 and 4, is fabricated from aluminum. As seen in these drawings, the aluminum cylinder head assembly 40, provides for each cylinder, to contain at least two air intake valves 42. Each valve 42 includes an upper end and a lower end. The upper end is secured via a hole through the valve stem and secured by a cotter pin to the top surface of the valve spring assembly and is located above the cylinder head. This upper end maintains a low tension valve spring 44. A valve guide, illustrated, but not labeled, extends through the head assembly and receives the valve 42 to provide for a portion of the lower end to be located within the cylinder. This valve guide is preferably fabricated from an oilite bearing. Oilite is an oil impregnated metal that enables operation without lubrication.

Also secured to the cylinder head assembly is a conventional electronic fuel injector 46 and conventional spark plug 48. The conventional fuel injector 46 extends interiorly into each cylinder.

This engine of the present invention, as seen in FIG. 1, will employ a belt driven or conventional supercharger 14, preferably utilizing the LYSHOLM supercharger. This super charger 14 should be affixed between the cylinder heads on the engine block, normally where the cam shaft would be located on a conventional engine. This will ultimately provide for an engine can be of a low profile which is crucial in today's modern automobile.

As seen in FIG. 1, secured to the bottom of the engines is the oil pan 56. This oil pan 56 is bolted to the engine block, with the oil 54 located therein. Located within the oil pan 56 is a oil strainer 58.

In operation, as seen in FIG. 1, an exhaust conduit 50 leading to an exhaust manifold is secured to the exhaust port on the outer side of each cylinder. The supercharger or air blower assembly 14, is coupled, via air passages 52 to the air intake valves 42. In the rest position, non-operating position, the piston 34 will be located on the lower portion of the cylinder, below the exhaust port 26.

Figures 5A, 5B, 5C:
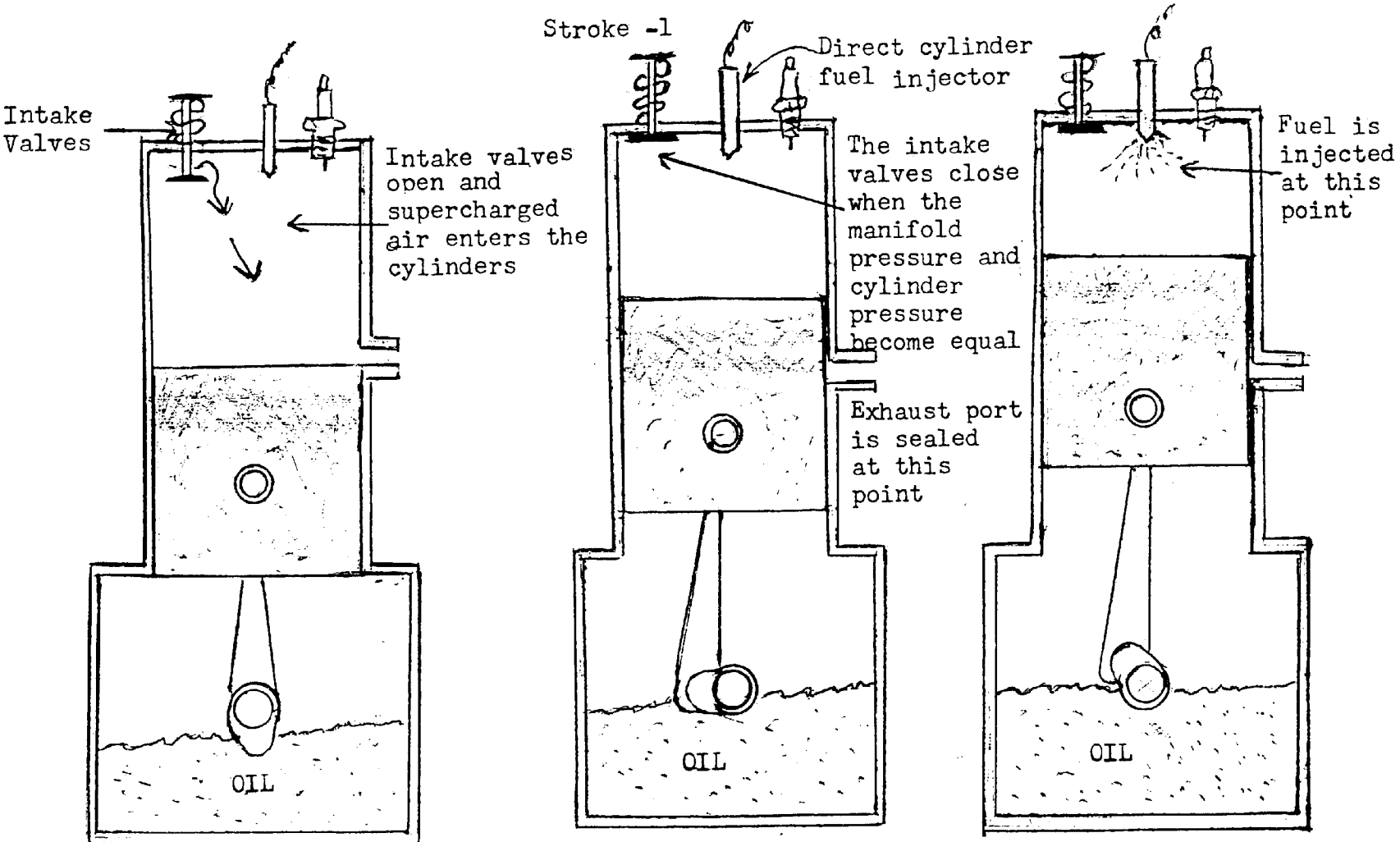
FIG. 5*a*–FIG. 5*e* are side views illustrating the two stroke process for operating the two cycle internal combustion engine of the present invention.

As seen in FIG. 5*a*, initiating the engine will cause the supercharger to be activated. Upon activation, the supercharger creates air flow and via air passages, forces air to the intake valve. The air causes the valve to open and enter the cylinder. Also, upon activation of the engine, the oil pump (not illustrated), which is secured to the front end of the crank shaft 38, actives and causes the it to rotate.

Rotation will force the piston upward, as seen in FIG. 5*b*. This upward movement of the piston will cause the exhaust port to be blocked, and thus will prevent air from escaping. With this simultaneous upward movement, air is continuously forced into the cylinder. The intake valve, as seen in FIG. 5*b*, closes when the manifold pressure and cylinder pressure become equal.

Once pressure is equalize, fuel is injected into the cylinder via the fuel injector 46. This is seen in figure 5*c*. This process, identified in FIGS. 5*a*–5*c* is conventionally known as the first stroke.

Figures 5D, 5E:
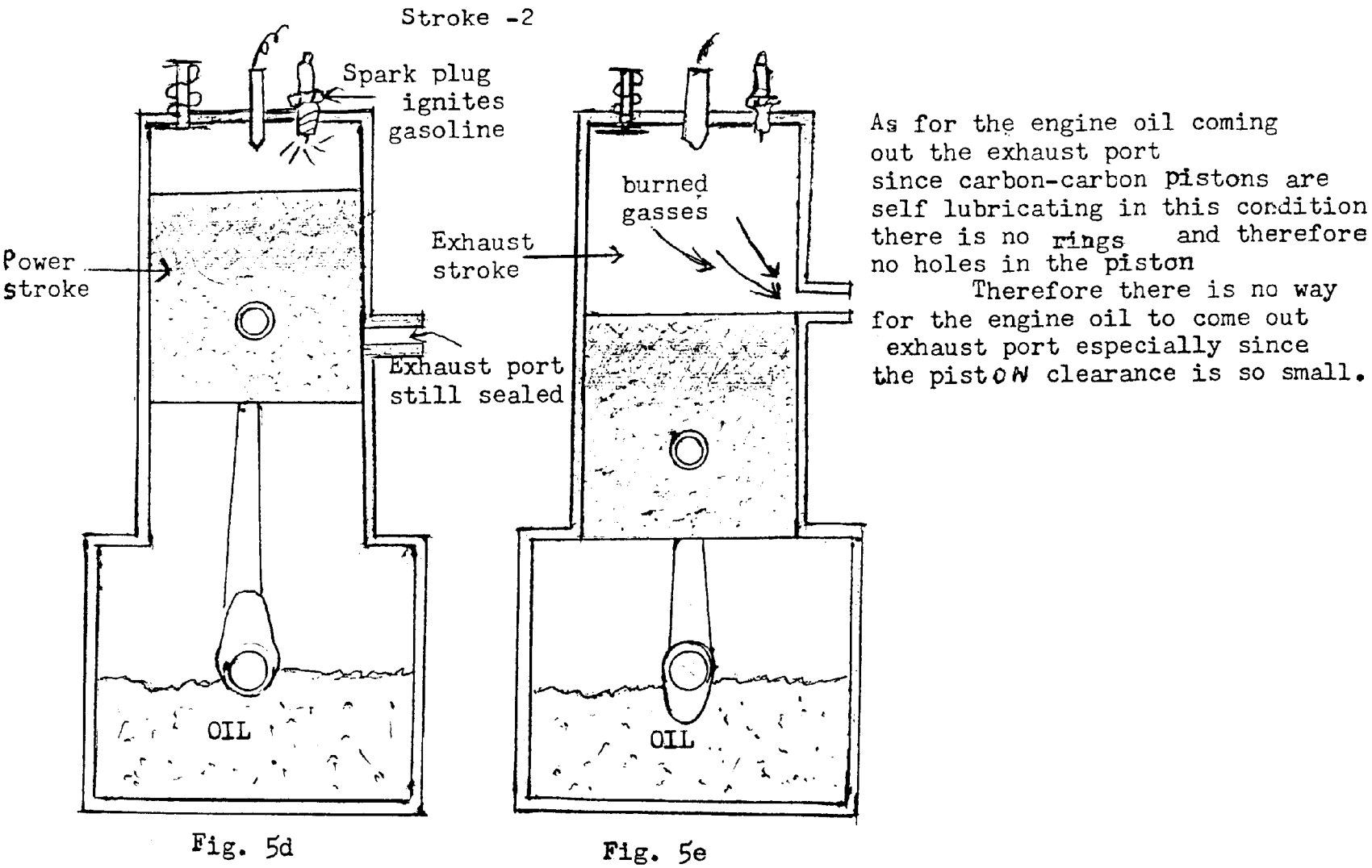

The next step is for the spark plug to ignite the gasoline, as seen in FIG. 5*d*. This will cause the ignited fuel and highly compressed air mixture to expand and push the moving piston downwardly. The downward motion forms the power or expansion stoke to the position as shown in FIG. 5*e*, and the cycle is repeated, as stated in FIGS. 5*a* through 5*b*.

It is noted that the valves will open when the boost pressure in the intake manifold exceeds the cylinder pressure and closes when the cylinder pressure exceeds the manifold pressure. To protect the valves, a covered is provided. This cover is a dust cover and will prevent debris and the like to attach to the valve and thus prolong the life span of the valves in use, since there is no crankcase oil lubrication to the valves.

As can be seen, the lubrication of the engine will be contained in the crankcase only. Since the oil pump is located on the front end of the crankshaft and is used for lubricating the main bearings, it is seen that there is no need for camshafts or other moving components, as generally associated with conventional engines. This reduction of moving components will inherently provide for an engine which is light weight and which will offer an engine with an increased torque and horse power, as well as a more fuel efficient vehicle, when compared to conventional four cycle engines.

While the invention has been particularly shown and described with reference to an embodiment thereof, it will be understood by those skilled in the art that various changes in form and detail may be made without departing from the spirit and scope of the invention.

I claim:

1. A two-stroke supercharged multi-cylinder internal combustion engine comprising:

a cylinder block fabricated from aluminum having preformed cylinder bores formed therein; a cylinder head on an upper end of the cylinder bore; a cylinder made of carbon—carbon composite is located within each bore and includes an exhaust port; coolant is located around said cylinder and between said cylinder block and said cylinder; a carbon—carbon composite piston is slidably mounted within said cylinder and is coupled to a rod, and said rod is coupled to a crankshaft; an oil reservoir is located under said crankshaft and a air distributor is located between said cylinder; and at least two intake valves, wherein said valve has a valve stem and includes an upper end and a lower end, and said upper end includes a valve spring assembly, an oilite valve guide extends through said cylinder head and receives said valve, at least one spark plug, at least one fuel injector is secured to said cylinder head, an oil pump is frontwardly secured to the crankshaft, and an oil strainer located in said oil reservoir.

2. A two-stroke supercharged multi-cylinder internal combustion engine as in claim 1 wherein said cylinder is coated with silicon carbide.

3. A two-stroke supercharged multi-cylinder internal combustion engine as in claim 1 wherein said piston is coated with silicon carbide.

4. A two stroke supercharger multi-purpose internal combustion engine as in claim 1 wherein a supercharger is affixed between said cylinder heads on said engine block.

* * * * *